US006257097B1

(12) United States Patent
I-He

(10) Patent No.: US 6,257,097 B1
(45) Date of Patent: Jul. 10, 2001

(54) RATCHET TOOL HAVING AN ECCENTRIC ROTATOR

(76) Inventor: Liao I-He, 11F-2, No. 43, Chai-I Street, Taichung City (TW)

( * ) Notice: Subject to any disclaimer, the term of this patent is extended or adjusted under 35 U.S.C. 154(b) by 0 days.

(21) Appl. No.: 09/677,513

(22) Filed: Sep. 29, 2000

(51) Int. Cl.[7] ..... B25B 13/46
(52) U.S. Cl. ..... 81/63; 81/57.3
(58) Field of Search ..... 81/62–63.2, 57.14, 81/57.3, 57.31

(56) References Cited

U.S. PATENT DOCUMENTS 2,542,015 * 2/1951 Ellison ..... 81/63
2,634,630 * 4/1953 Johnson ..... 81/62
2,680,983 * 6/1954 Miller ..... 81/62
3,828,629 * 8/1974 Moore ..... 81/57.3
4,475,420 * 10/1984 Atkinson et al. ..... 81/63

* cited by examiner

*Primary Examiner*—D. S. Meislin
(74) *Attorney, Agent, or Firm*—Charles E. Baxley

(57) ABSTRACT

A ratchet tool includes a head in which a disk is engaged and the disk has an engaging member extending from an end of the head. A flange extends from the disk and the flange has toothed inner periphery. A toothed rotator is engaged with the toothed inner periphery of the disk and located eccentrically to the a center of the disk. A ratchet device is received in a recess in an inner periphery of the head and includes a pawl member which is engaged with the toothed rotator. A number of the teeth of the toothed inner periphery of the disk is multiple times of the teeth of the rotator. The pawl member is rotated multiple revolutions while the disk is rotated one revolution. By this way, the ratchet tool is operated with less force.

8 Claims, 5 Drawing Sheets

RATCHET TOOL HAVING AN ECCENTRIC ROTATOR

FIELD OF THE INVENTION

The present invention relates to a ratchet tool that is required less force to rotate. The engaging member for connecting a socket is rotated one revolution while the ratchet tool is rotated multiple revolutions.

BACKGROUND OF THE INVENTION

A conventional ratchet tool 1 is shown in FIG. 1 and generally includes a head having a space 10 for receiving an operation member 11 therein and a hole 101 defined in a bottom of the head of the tool 1 so that a socket releasing rod 100 extends through the hole 101 and a passage 111 in the operation member 11. A pawl member 12 received in the head of the tool 1 and has a curved toothed surface 120 for engaging with a toothed periphery 110 of the operation member 11. The pawl member 12 is pivotally received in a pawl receiving member 13 in the head and a protrusion 121 is movably received in a slot 131 of the pawl receiving member 13. A ball 140 and a spring 14 are received in a recess 132 in an inside of the pawl receiving member 13. The ball 140 is biased by the spring 14 and contacts a positioning portion 122 of the pawl member 12. A lever 130 extends from the pawl receiving member 13 and is accessed from an outside of the tool 1 so that when pushing the lever 130, the pawl member 12 is pivoted and is positioned by the ball 140 pushing the positioning portion 122. One of two sides of the pawl member 12 contacts against an inside of the head so that when the tool 1 is rotated in one direction to let the inside of the head push the pawl member 12, a torque is applied to an object engaged with the operation member 11. If the tool 1 is rotated in the other direction, the pawl member 12 pushes the ball 140 to compress the spring 14, and the pawl member 12 moves over the teeth of the toothed periphery 110 of the operation member 11 while the operation member 11 is maintained still. However, the operation member 11 of the conventional ratchet tool can only be rotated one revolution as the tool 1 is rotated one revolution. This means that when an object is screwed so firm, the user has to apply a larger force to rotate the ratchet tool 1 so that if the user cannot apply such a large force, he/she has no choice to give up.

The present invention relates to a ratchet tool which has a disk with an engaging member extending therefrom for engaging with a socket and the disk has a flange having toothed inner periphery. A toothed rotator eccentrically and rotatably engages with the toothed inner periphery of the disk. A ratchet means is engaged with the rotator so that when the ratchet tool rotates multiple revolutions, the engaging member rotates one revolution. This means the user uses less force to rotate the socket.

SUMMARY OF THE INVENTION

In accordance with one aspect of the present invention, there is provided a ratchet tool and comprising a ring-shaped head and a recess defined in an inner periphery of the head. A disk has an engaging member extending from a surface thereof and a flange extends from the other surface of the disk. The flange has a toothed inner periphery with which a rotator is engaged. An axis "P" of the rotator is located at a position which is eccentric to an axis "P1" of the disk. A pawl receiving member is received in the recess and a pawl member is pivotally and movably connected to the pawl receiving member. The pawl member has a toothed surface which is engaged with the rotator. A positioning means is located between the pawl receiving member and the pawl member. The positioning means urges the pawl member to engage with the toothed periphery of the rotator. The number of the teeth of the toothed inner periphery of the disk is larger than the number of the teeth of the rotator so that the ratchet tool is rotated multiple revolutions while the disk is rotated one revolution.

The primary object of the present invention is to provide a ratchet tool which can be rotated with less force.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
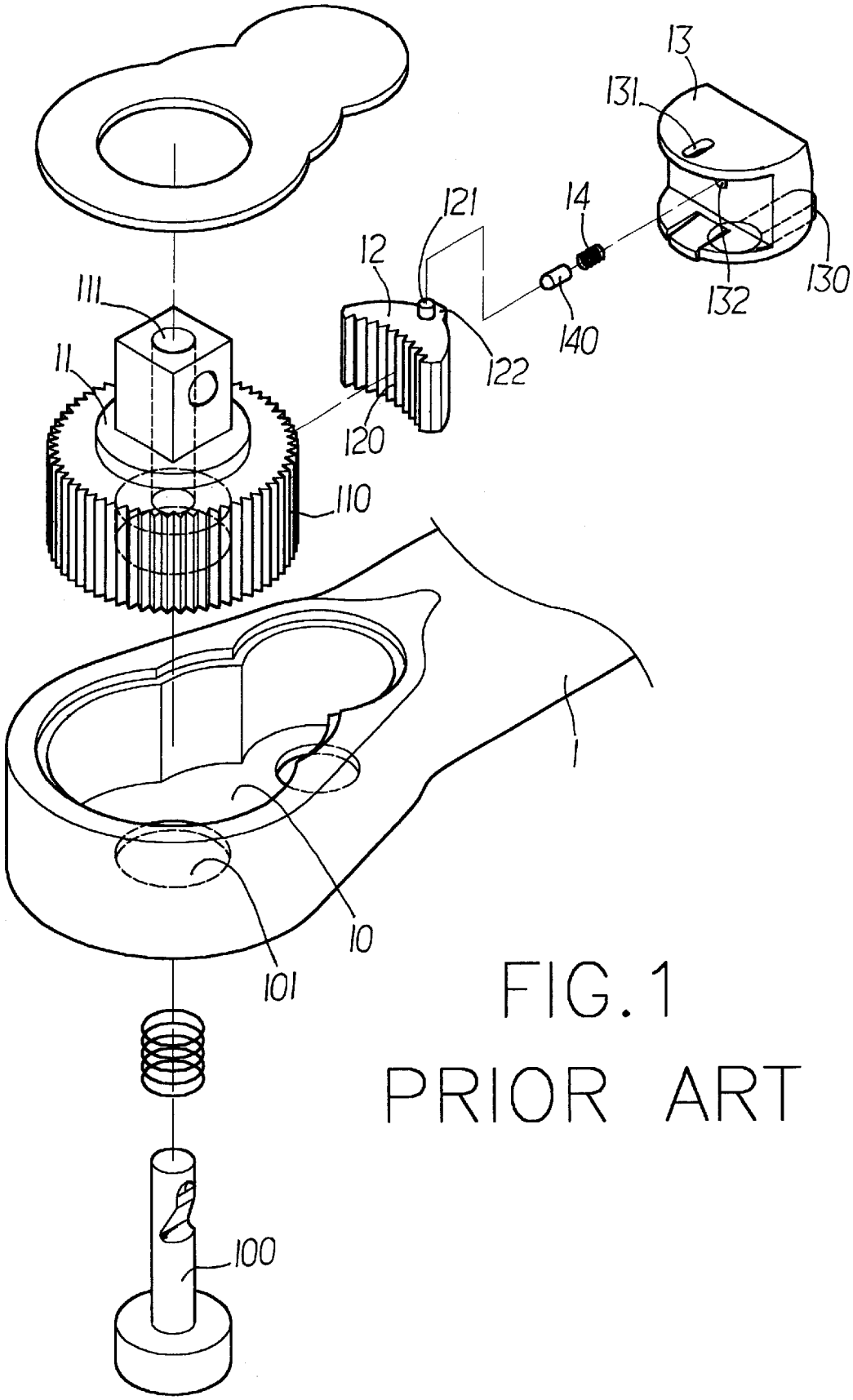
FIG. 1 PRIOR ART
FIG. 1 is an exploded view to show a conventional ratchet tool.
Figure 2:
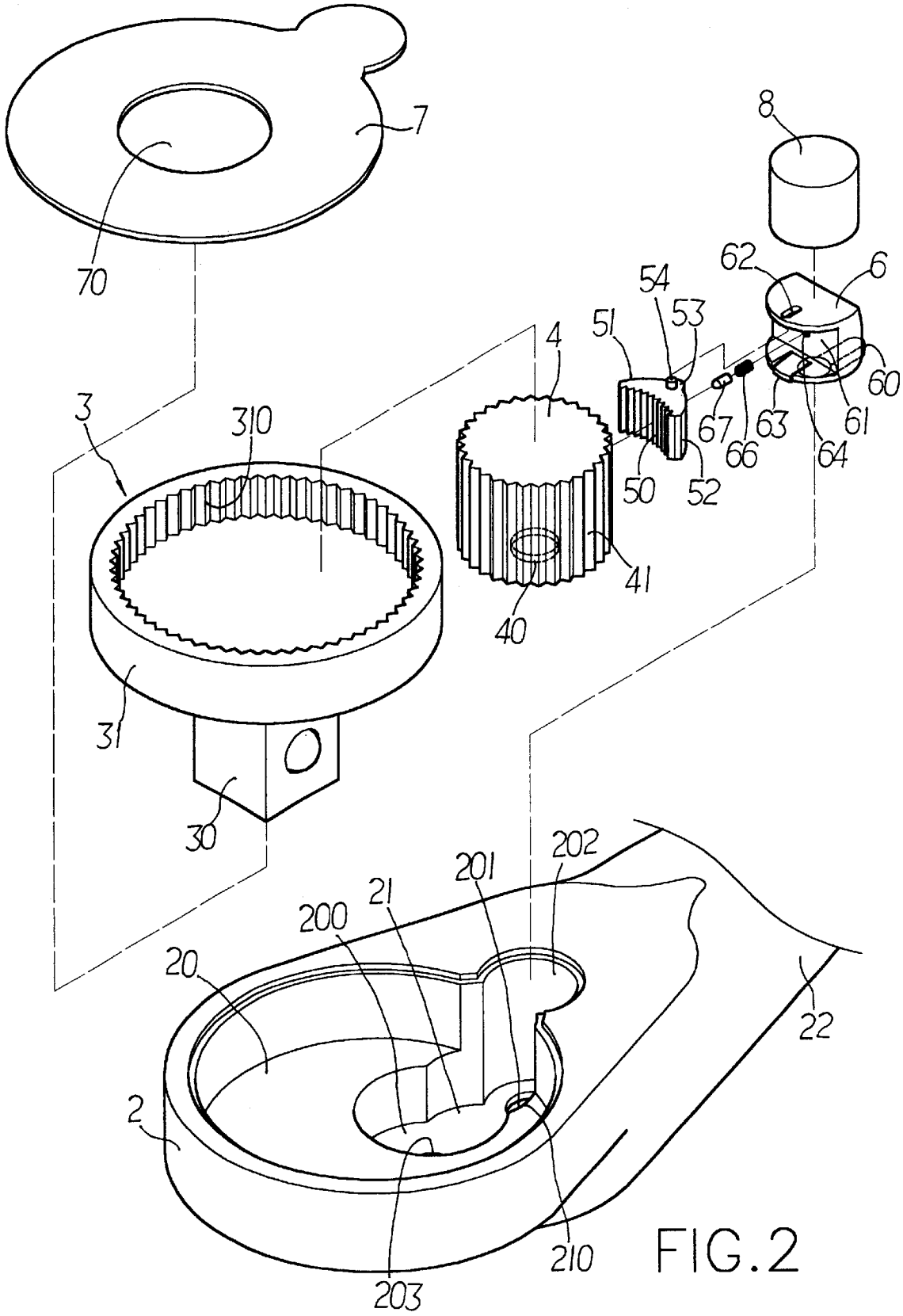
FIG. 2 is an exploded view to show a ratchet tool of the present invention.
Figure 3:
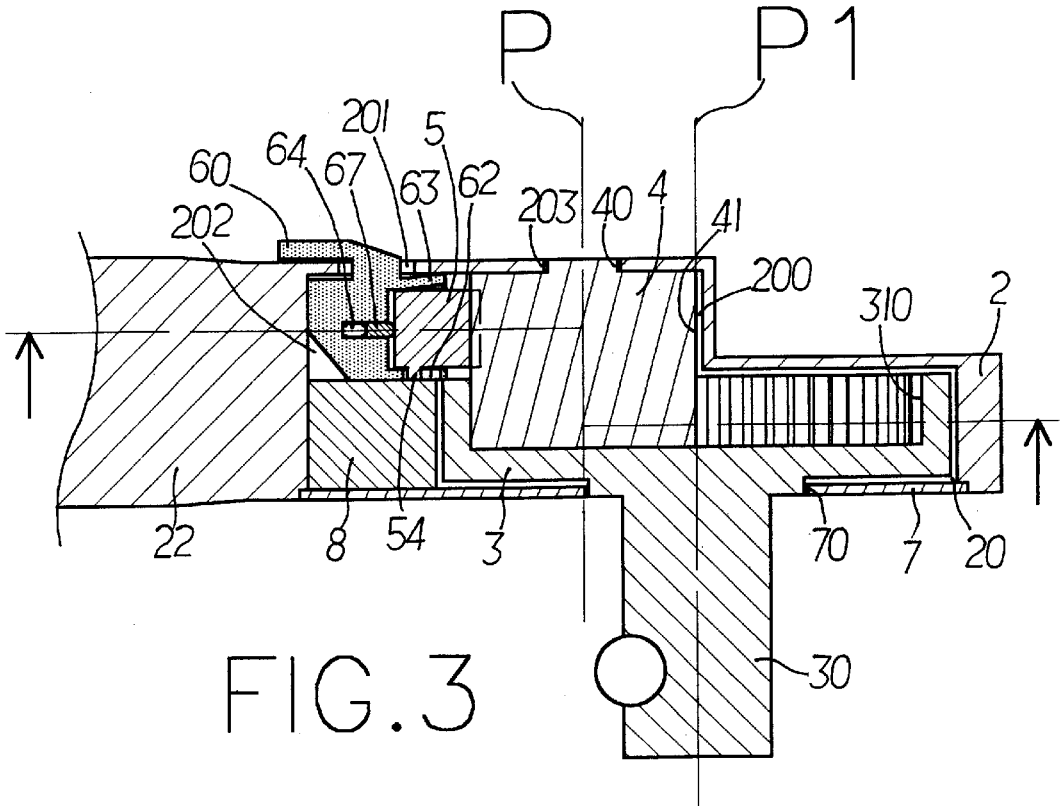
FIG. 3 is a side elevational view, partly in section, of the ratchet tool of the present invention.
Figure 4:
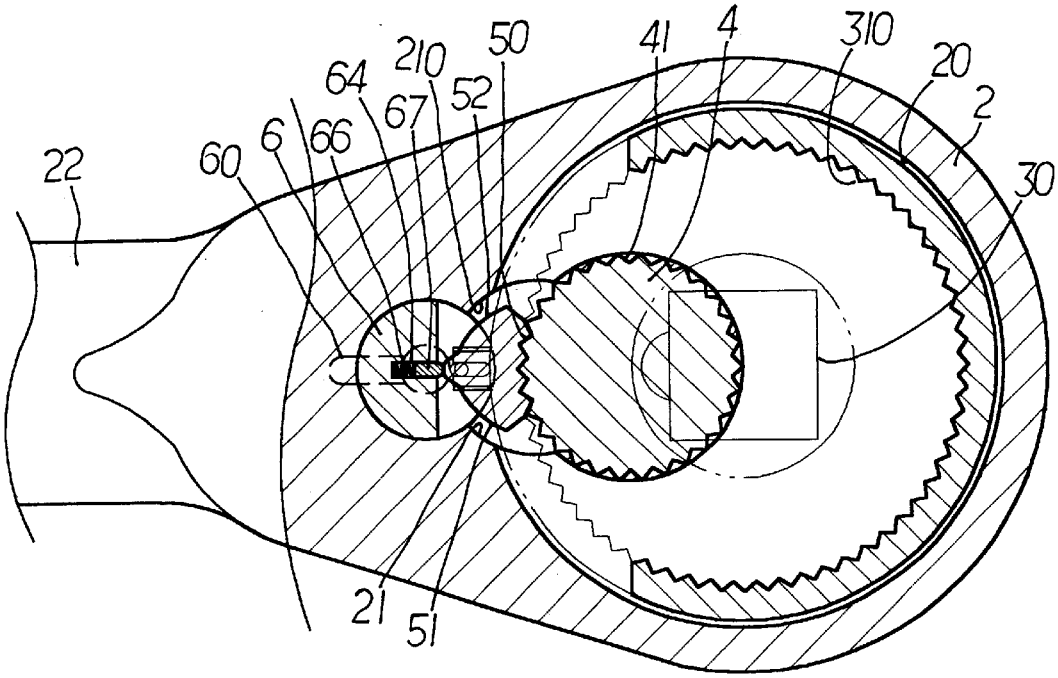
FIG. 4 is a plan view to show that a pawl member of the ratchet tool is located at a neutral position.

Referring to FIGS. 2 to 4, the ratchet tool of the present invention comprises a shank 22 with a ring-shaped head 2 connected to an end thereof and a plate 7 is connected to one of two ends thereof and a first step surface 20 connected to the other end of the head 2. The first step surface 20 has a recessed space defined therein which is defined by a second step surface 200 extending from the first step surface 20. A first hole 201 and a second hole 203 are respectively defined through the second step surface 200. A recess 202 is defined in an inner periphery of the head and communicates with the recessed space.

A disk 3 is received in the head 2 and located between the first step surface 20 and the plate 7. An engaging member 30 extends from a surface of the disk 3 and extends through a hole 70 in the plate 7 so as to be connected with a socket or the like and the socket is able to engage an object. A flange 31 extends from the other surface of the disk 3 and the flange 31 has a toothed inner periphery 310.

A rotator 4 has a toothed periphery 41 and a protrusion 40 extends from a surface of the rotator 4. The rotator 4 is received in the head 2 and located between the second step surface 200 and the plate 7. The protrusion 40 is rotatably engaged with the second hole 203 in the second step surface 200 and the toothed periphery 41 is engaged with the toothed inner periphery 310 of the disk 3. It is to be noted that an axis "P" of the rotator 4 is located at a position which is eccentric to an axis "P1" of the disk 3. The number of the teeth of the toothed inner periphery of the disk 3 is multiple times of the teeth of the rotator 4.

A pawl receiving member 6 is received in the recess 202 and a pawl member 5 is pivotally and movably connected to the pawl receiving member 6. The pawl receiving member 6 has a first flange and a second flange extending therefrom wherein the first flange has a slot 62 and a lever 60 is connected to the second flange of the pawl receiving member 6. The lever 60 extends from the first hole 201 in the second step surface 200. A positioning plate 63 splits from the second flange of the pawl receiving member 6 so that when the pawl receiving member 6 is received in the recess 202, the positioning plate 63 is compressed by the second step surface 200 so as to firmly position the pawl receiving member 6.

The pawl member 5 is located between the first flange and the second flange of the pawl receiving member 6. A protrusion 54 extends from the pawl member 5 and is movably retained in the slot 62. The pawl member 5 has a toothed surface 50 which is engaged with the toothed periphery 41 of the rotator 4. The pawl member 5 has a positioning portion 53 which faces the pawl receiving member 6. A positioning means comprising a rod 67 and a spring 66 is located between the pawl receiving member 6 and the pawl member 5. The pawl receiving member 6 has a notch 64 defined therein and the spring 66 and the rod 67 are received in the notch 64. The spring 66 biases the rod 67 toward the pawl member 5 to let the toothed surface 50 of the pawl member 5 engage with the toothed periphery 41 of the rotator 4. A block 8 is received between the pawl receiving member 6 and the plate 7 to support the pawl receiving member 6.

The recessed space is defined by a C-shaped inner periphery and the recess 202 is defined by another C-shaped inner periphery. Two sidewalls 21, 22 are connected between two ends of the C-shaped inner periphery of the recessed space and two ends of the C-shaped inner periphery defining the recess 202. The pawl member 5 is located between the two sidewalls 21, 22.

As shown in FIG. 4, when the pawl member 5 is located in a neutral position, the positioning portion 53 of the pawl member 5 is engaged with the rod 67.

Figure 5:
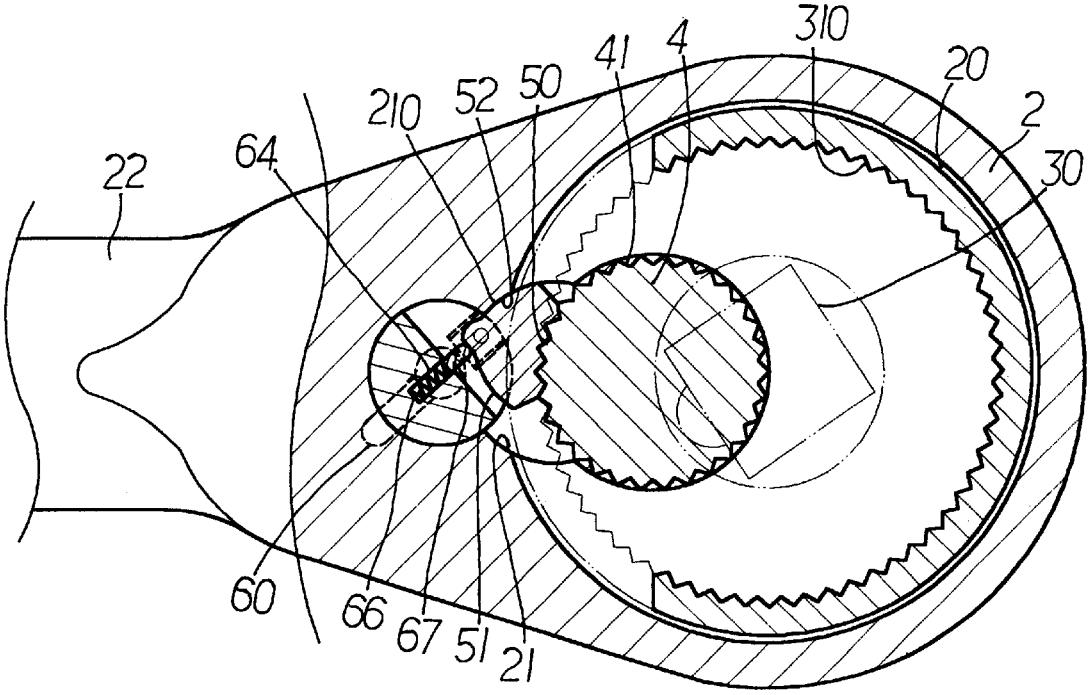
FIG. 5 is a plan view to show the pawl member is pivoted when a user pivots a lever counter clockwise.

As shown in FIG. 5, when pivoting the lever 60 counter clockwise, the pawl receiving member 6 is pivoted and the pawl member 5 is pivoted together with the pawl receiving member 6 because the protrusion 54 of the pawl member 5 is retained in the slot 62. The rod 67 urges a first section 52 of the periphery of the pawl member 5 to contact the sidewall 22. When rotating the shank 2 counter clockwise, the sidewall 22 pushes the first section 52 of the periphery of the pawl member 5. The pawl member 5 and the rotator 4 are now connected as a one-piece combination so that the rotator 4 is rotated with the tool and the disk 3 is rotated by the rotator 4. Because the number of the teeth of the toothed inner periphery 310 of the disk 3 is larger than the number of the teeth of the toothed rotator 4 so that the rotator 4 and the tool rotate multiple revolutions while the disk 3 rotates one revolution. In other words, the user uses less force to rotate the tool many revolutions to let the disk 3 rotate one revolution. This means the user can use less force to tighten or loosen an object although the user has to rotate the tool many revolutions. This is particularly suitable for the users who cannot provide enough force to rotate the ratchet tool.

When the tool is rotated clockwise, the rotator 4 applies a force the pawl member 5 to push the pawl member 5 to compress the spring 66 and the protrusion 54 of the pawl member 5 is movable within the slot 62. Therefore, the toothed surface 50 of the pawl member 5 moves over the toothed outer periphery 41 of the rotator 4 so that the ratchet tool can be repeatedly operated without removing the socket from the object.

Figure 6:
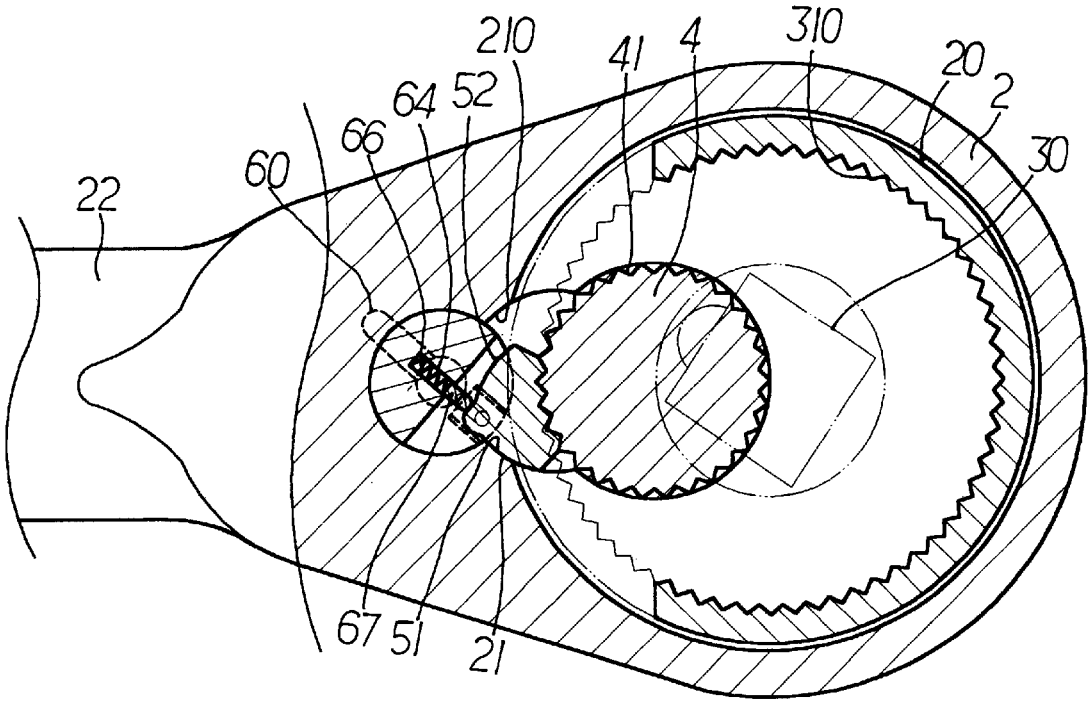
FIG. 6 is a plan view to show that the pawl member is pivoted when a user pivots a lever clockwise.

As shown in FIG. 6, when the lever 60 is pivoted counter clockwise, a second section 51 of the periphery of the pawl member 5 is pushed to contact the other sidewall 21. Therefore, the pawl member 5 moves over the rotator 4 when the tool is rotated counter clockwise while the disk 3 is remained still, and the disk 3 is rotated with the operation of the tool when the tool is rotated clockwise.

Figure 7:
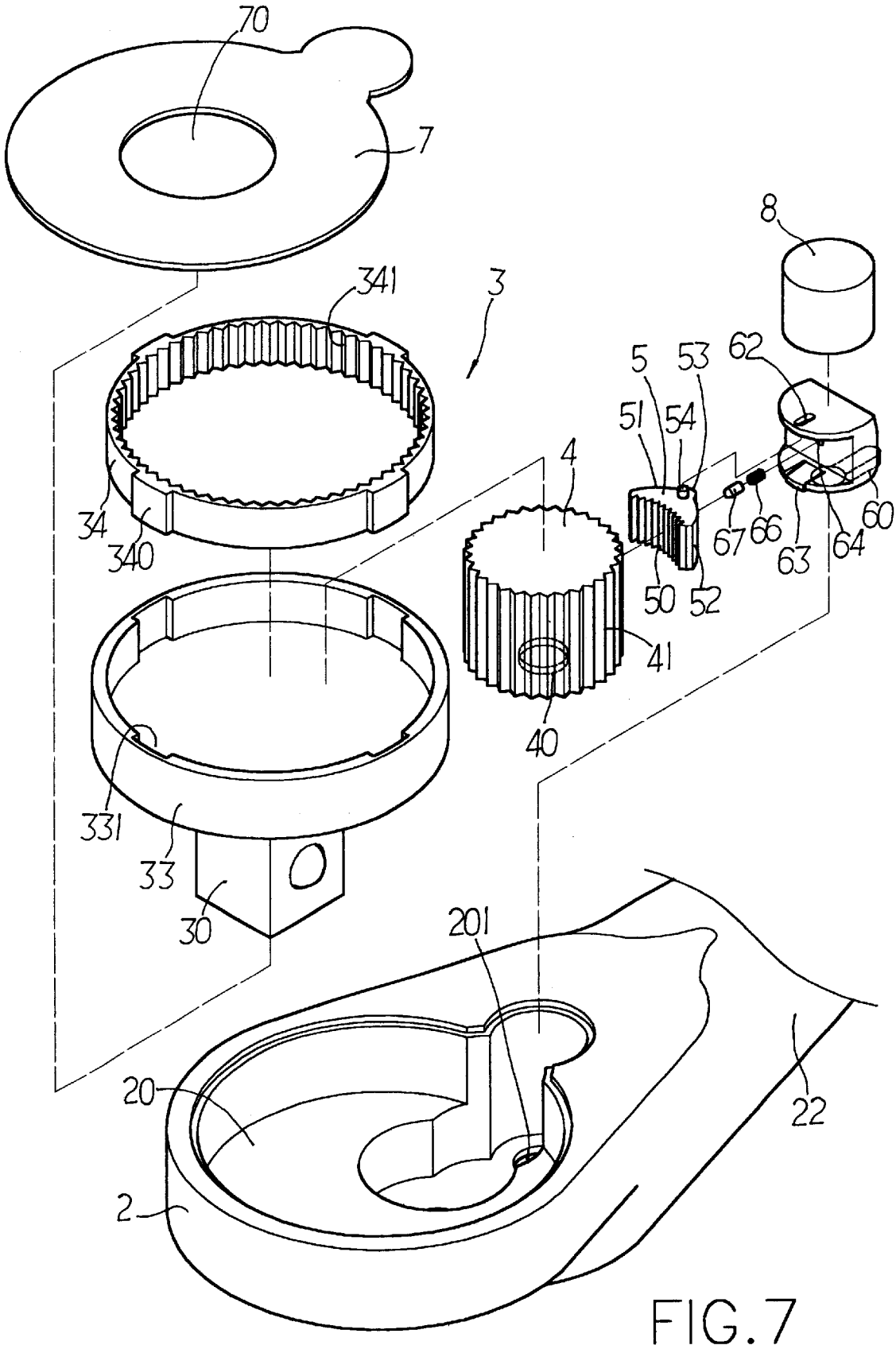
FIG. 7 is an exploded view to show another embodiment of the ratchet tool of the present invention.

FIG. 7 shows another embodiment of the disk 3 wherein the flange 33 of the disk 3 has a plurality of notches 331 defined in the inner periphery thereof and a ring 34 is engaged with the inner periphery of the flange 33. The ring 34 has a plurality of projections 340 extending from an outer periphery thereof and the projections 340 are engaged with the notches 331. The ring 34 has the toothed inner periphery 341 so that the ring 34 can be replaceable to change the type of the toothed inner periphery of the ring 34.

While we have shown and described various embodiments in accordance with the present invention, it should be clear to those skilled in the art that further embodiments may be made without departing from the scope and spirit of the present invention.

What is claimed is:

1. A ratchet tool comprising:

a ring-shaped head having a plate connected to one of two ends thereof and a first step surface connected to the other end of said head, said first step surface having a recessed space defined therein which is defined by a second step surface extending from said first step surface, a first hole and a second hole defined through said second step surface, a recess defined in an inner periphery of said head and communicating with said recessed space;

a disk having an engaging member extending from a surface thereof and a flange extending from the other surface of said disk, said flange having a toothed inner periphery, said disk received in said head and located between said first step surface and said plate, said engaging member extending through said plate;

a rotator having a toothed periphery and a protrusion extending from a surface of said rotator, said rotator received in said head and located between said second step surface and said plate, said protrusion rotatably engaged with said second hole in said second step surface, an axis "P" of said rotator located at a position which is eccentric to an axis "P1" of said disk, said toothed periphery engaged with said toothed inner periphery of said disk;

a pawl receiving member received in said recess and a pawl member pivotally and movably connected to said pawl receiving member, said pawl member having a toothed surface engaged with said toothed periphery of said rotator, said pawl member having a positioning portion which faces said pawl receiving member, and a positioning means located between said pawl receiving member and said pawl member, said positioning means urging said pawl member to engage with said toothed periphery of said rotator.

2. The ratchet tool as claimed in claim 1, wherein said pawl receiving member has a first flange and a second flange extending therefrom, said first flange having a slot, said pawl member located between said first flange and said second flange, a protrusion extending from said pawl member and movably retained in said slot.

3. The ratchet tool as claimed in claim 2 further comprising a lever connected to said second flange of said pawl receiving member and extending from said first hole in said second step surface.

4. The ratchet tool as claimed in claim 2 further comprising a positioning plate which splits from said second flange of said pawl receiving member.

5. The ratchet tool as claimed in claim 1 wherein said pawl receiving member has a notch defined therein and said positioning means engaged with said notch.

6. The ratchet tool as claimed in claim 5, wherein said positioning means includes a rod and a spring which biases said rod toward said pawl member.

7. The ratchet tool as claimed in claim 1, wherein said recessed space is defined by a C-shaped inner periphery and said recess is defined by a C-shaped inner periphery, two sidewalls respectively connected between two ends of said C-shaped inner periphery of said recessed space and two ends of said C-shaped inner periphery defining said recess, said pawl member located between said two sidewalls.

8. The ratchet tool as claimed in claim 1, wherein said flange of said disk has a plurality of notches defined in said inner periphery thereof and a ring has a plurality of projections extending from an outer periphery thereof said projections engaged with said notches, said ring having said toothed inner periphery.

* * * * *